US006660980B2

(12) United States Patent
Nagata et al.

(10) Patent No.: US 6,660,980 B2
(45) Date of Patent: Dec. 9, 2003

(54) TOP PLATE FOR COOKING DEVICE HAVING ELECTROMAGNETIC-INDUCTION HEATING UNIT

(75) Inventors: Takeshi Nagata, Otsu (JP); Narutoshi Shimatani, Uji (JP); Shingo Nakane, Otsu (JP); Naohide Yamada, Muko (JP)

(73) Assignee: Nippon Electric Glass Co., Ltd., Otsu (JP)

( * ) Notice: Subject to any disclaimer, the term of this patent is extended or adjusted under 35 U.S.C. 154(b) by 0 days.

(21) Appl. No.: 10/167,525

(22) Filed: Jun. 12, 2002

(65) Prior Publication Data

US 2003/0006231 A1 Jan. 9, 2003

(30) Foreign Application Priority Data

| | | |
|---|---|---|
| Jun. 12, 2001 | (JP) | 2001-176568 |
| Jun. 12, 2001 | (JP) | 2001-176569 |
| Jun. 12, 2001 | (JP) | 2001-176607 |
| Jun. 12, 2001 | (JP) | 2001-176609 |
| Nov. 30, 2001 | (JP) | 2001-367340 |
| Mar. 15, 2002 | (JP) | 2002-071359 |
| Mar. 15, 2002 | (JP) | 2002-071360 |

(51) Int. Cl.[7] ..... H05B 6/12; H05B 3/74

(52) U.S. Cl. ..... 219/622; 219/649; 219/460.1; 219/506; 219/452.12

(58) Field of Search ..... 219/622, 620, 219/627, 649, 647, 506, 452.12, 460.1, 460.2, 460.3, 445.1, 448.11

(56) References Cited

U.S. PATENT DOCUMENTS

| | | | | |
|---|---|---|---|---|
| 3,742,174 A | | 6/1973 | Harnden | |
| 4,833,288 A | * | 5/1989 | Poumey | 219/622 |
| 5,280,152 A | * | 1/1994 | Lee | 219/622 |
| 2002/0084263 A1 | * | 7/2002 | Wennemann et al. | 219/460.1 |

FOREIGN PATENT DOCUMENTS

| | | | | |
|---|---|---|---|---|
| DE | 198 27 298 | | 9/1999 | |
| DE | 200 19 210 | | 3/2001 | |
| FR | 2763301 | | 11/1998 | |
| GB | 2 223 093 | * | 3/1990 | 219/622 |
| JP | 3-65532 | | 3/1991 | |
| JP | 3-114182 | | 5/1991 | |
| JP | 10-273342 | | 10/1998 | |

OTHER PUBLICATIONS

Patent Abstracts of Japan & JP 03 114182.

Patent Abstracts of Japan vol. 1995, No. 11 & JP 07 201462 (ENCL.).

* cited by examiner

*Primary Examiner*—Philip H. Leung
(74) *Attorney, Agent, or Firm*—Collard & Roe, P.C.

(57) ABSTRACT

A top plate is provided for use in a cooking device having an induction heater alone or an infrared heater in addition, which comprises a transparent crystallized glass plate, a light-shading film on a bottom surface of the glass plate and an ornamental film formed on the top surface of the glass plate. The light-shading film is a porous layer of inorganic pigment powder dispersed in glass matrix. The light-shading film has small apertures at a portion corresponding to the infrared heater. Alternatively, it has a decreased thickness at the portion. In another alternative, a luster film is used in place of the inorganic pigment layer at the portion corresponding to the infrared heater.

15 Claims, 5 Drawing Sheets

TOP PLATE FOR COOKING DEVICE HAVING ELECTROMAGNETIC-INDUCTION HEATING UNIT

BACKGROUND OF THE INVENTION

1. Field of the Invention

This invention relates to a top plate for cooking device having an electromagnetic-induction heating unit, and optionally having an infrared heating unit.

2. Prior Art

As heating units used in electrical cooking devices, there are known a infrared heating unit such as a radiant heater and a halogen heater, and an electromagnetic-induction heating unit using an induction heater.

A cooking device having the infrared heating unit has a top plate. The top plate has usually been made of a dark-colored crystallized glass plate which shades or cut off the visible light but transmits the infrared light. Shading of the visible light is for keeping the internal structure of the device non-operated out of sight as well as for attenuating the strong radiation including the visible light component from the halogen heater so as to decrease the brightness. The red heat of the heater unit operated can be seen through the dark-colored top plate, by which the operation of the heating device can be identified.

Another cooking device having the electromagnetic-induction heating unit does not generate the visible light component. Therefore, it is impossible to see whether the device is operating or not. In order to resolve the problem, the cooking device of the electromagnetic induction type is provided with a power indicator comprising, of example, light emission diodes (LEDs) for providing visible indication of a heating power which the device is generating. The power indicator is, in a recent leading design, disposed adjacent the electromagnetic induction heating unit and can, therefore, be seen through the top plate, as disclosed in JP 3-114182 A, although there is another design where it is mounted on an outer surface of a side wall of the device. However, the light from LEDs is weak so that it cannot be seen through the dark-colored top plate. Therefore, a light-transparent crystallized glass plate is mainly used for the top plate in the cooking device having the electromagnetic induction-type heating unit of the leading design described above.

In use of the light-transparent top plate, the internal structure such as the heating unit can be seen through the top plate. It is desired to screen the internal structure because of ornamental reasons.

A light-transparent crystallized glass plate, per se, has a smooth, flat and glossy surface, which is suitable for a top surface of the top plate. On the other hand, any ornamental coating is desired on the top surface for indicating the portions heated by the heater unit or units and for printing description how to use and/or warning phrases or sentences thereon.

It may be possible to use the ornamental coating as shading the internal structure. However, the ornamental coating is easily subjected to cracks caused due to thermal differences between different portions thereof. In order to avoid the cracks, the ornamental film may be made as a porous layer. However, the porous layer is not good as an ornamental film and is insufficient for printing the description. The porous layer is further worn by contact and friction with cooking wares such as pan, pot, dish and others.

SUMMARY OF THE INVENTION

Therefore, it is an object of this invention to provide a top plate for a cooking device having an electromagnetic heating unit which has a smooth, flat and glossy top surface and can shade the internal structure of the device.

According to this invention, a top plate in a cooking device having an electromagnetic-induction heating unit comprises:

- a light-transparent crystallized glass plate with a top surface, on which foods are heated, and with a bottom surface confronting the electromagnetic-induction heating unit;
- an ornamental film entirely or partially coated on said top surface, said ornamental film being a dense layer comprising a first inorganic pigment, and;
- a light-shading film entirely or partially coated on said bottom surface, said light-shading film being a porous layer comprising a second inorganic pigment.

According to an embodiment, the dense layer comprises a first inorganic pigment powder and glass, while the porous layer comprises a second inorganic pigment powder and glass.

The dense layer is higher than the porous layer in the glass percentage content.

According to another embodiment, the top plate has a heated portion heated by the electromagnetic-induction heating unit, and the top plate further comprises a heat resistant resin layer formed on at least one area of the light-shading film corresponding to the heated portion.

The heat-resistant resin layer may comprise one or more selected from a group of polyimide resin, polyamide resin, fluorine-contained polymer, and silicone resin.

According to another aspect of this invention, the top plate is provided to be used in a cooking device having an infrared heating unit in addition to the electromagnetic-induction heating unit. The top plate has a first heated portion heated by the electromagnetic-induction heating unit and a second heated portion heated by said infrared heating unit.

According to another embodiment, the light-shading film is lower in the density at the second heated portion than that at the first heated portion.

According to another embodiment, the density of the light-shading film at the second heated portion is 30–80% of that at the first heated portion.

According to another embodiment, the light-shading film is a lot of apertures at the second heated portion.

Each of the apertures preferably has 0.05–5 mm diameter.

The number of apertures is preferably 5–500 per 1 $cm^2$.

According to another embodiment, the light-shading film is smaller in the thickness at the second heated portion than that at the first heated portion.

In a preferred embodiment, the thickness of the light-shading film at the second heated portion is 10–50% of that at the first heated portion.

According to a further different embodiment, the light-shading film is formed in a luster layer at the second heated portion.

DESCRIPTION OF THE PREFERRED EMBODIMENTS

Figure 1:
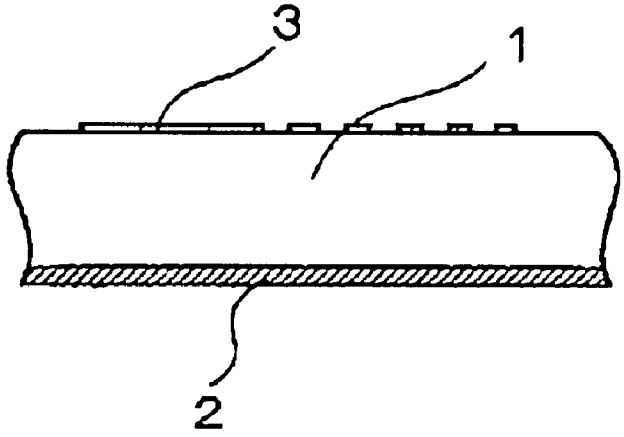
FIG. 1 is a sectional view of a part of a top plate according to an embodiment of this invention.

The top plate according to this invention is provided with an ornamental film on a top surface of the plate and a light-shading film on the bottom surface of the plate.

A crystallized glass plate per se has a smooth, flat and glossy surface. Therefore, it is desired that the ornamental film is applied to a limited area on the top surface of the crystallized glass plate and that the ornamental film is strongly bonded on the crystallized glass and has a smooth, flat and glossy surface.

To this end, the ornamental film is formed as a dense inorganic pigment layer, which comprises inorganic pigment and glass. It is desirable that the glass contents are high, preferably 50 weight % or more, so that the inorganic pigment layer can be sintered with a high density and a smooth, flat and glossy surface.

For the inorganic pigments used, there is raised white pigment powder such as $TiO_2$, $ZrO_2$, $ZrSiO_4$ or others, blue pigment powder such as Co—Al—Zn powder, Co—Al—Si powder, or Co—Al—Ti powder, green pigment powder such as Co—Al—Cr powder, and Co—Ni—Ti—Zn powder, yellow pigment powder such as Ti—Ni powder, red pigment powder such as Co—Si powder, brown pigment powder such as Ti—Fe—Zn powder, Fe—Zn powder, Fe—Ni—Cr powder, or Zn—Fe—Cr—Al powder, black pigment powder such as Cu—Cr powder, Cu—Cr—Fe powder, or Cu—Cr—Mn powder, and so on.

The glass powder used is $B_2O_3$—$SiO_2$, $Na_2O$—CaO—$SiO_2$, $Li_2O$—$Al_2O_3$—$SiO_2$, ZnO—$Al_2O_3$—$P_2O_5$, or the like.

The inorganic pigment layer as the ornamental film has a thickness of, preferably, 0.1–50 $\mu$m, more preferably, 0.2–40 $\mu$m. It is sufficient for the purpose of the ornament to have 0.1 $\mu$m thickness at the minimum. The film is tend to easily peel off, if it is thicker than 50 $\mu$m. It is also desired to have 50 $\mu$m thickness at the maximum in the cost of the material and production.

Top plates used are often melted and used for materials for glass. The inorganic pigments in the ornamental film invade the glass as impurities to color the glass. However, the thickness of 50 $\mu$m or less cannot provide an amount of pigments sufficient to color the glass reproduced.

The light-shading film on the bottom surface of the crystallized glass plate is a porous inorganic pigment layer that also comprises inorganic pigment and glass. The light-shading film is not thermally cracked due to the difference from the crystallized glass plate in the thermal expansion coefficient because the film is porous. In order to form the porous layer, the mixture ratio of the inorganic pigment powder and the glass powder is preferably 5:5 to 9:1, more preferably, 5:5 to 8:2, in weight. The glass contents of 50 weight % or less in the mixture can easily provide a porous layer without the glass being densely sintered.

The inorganic pigment powder used is at least one selected from a group of $TiO_2$, $ZrO_2$, and $ZrSiO_4$. The other useful pigment powder is a oxide pigment of Co—Al—Zn, Co—Al—Si, Co—Al—Ti, Co—Al—Cr, Co—Ni—Ti—Zn, Ti—Sb—Cr, Ti—Ni, Co—Si, Ti—Fe—Zn, Fe—Zn, Fe—Ni—Cr, Zn—Fe—Cr—Al, Co—Cr—Fe, Cu—Cr, Cu—Cr—Fe, or Cu—Cr—Mn. These pigments powder can be alone or in combination.

The glass powder used in the light-shading film is also $B_2O_3$—$SiO_2$, $Na_2O$—CaO—$SiO_2$, $Li_2O$—$Al_2O_3$—$SiO_2$, ZnO—$Al_2O_3$—$P_2O_5$, or the like.

The porous inorganic pigment layer as the light-shading film also has a thickness of, preferably, 0.1–50 $\mu$m, more preferably, 0.240 $\mu$m. It is sufficient for the purpose of the light-shading to have 0.1 $\mu$m thickness at the minimum. The film is also tend to easily peel off, if it is thicker than 50 $\mu$m. It is also desired to have 50 $\mu$m thickness at the maximum, in the view point of cost of the material and production and of use for glass materials.

In use of the top plate for a cooking device having an infrared heater in addition to the induction heater, it is necessary that the light-shading film of the top plate is increased in the infrared light transmittance at an area confronting the infrared heater. To this end, the light-shading film is partially lowered in the coating density.

The "coating density" is determined as a rate of a coating area per a unit area. For example, when a coating is deposited over a total area of 0.5 $cm^2$ within a unit area of 1 $cm^2$ of a top plate surface, the coating density is referred to as 50%.

A "coating density on an infrared heater corresponding portion" means an average coating density on a portion of the top plate confronting the infrared heater. The portion of the top plate confronting the infrared heater means a heated portion by the infrared heater. A "coating density on an induction heater corresponding portion" means an average coating density on a portion of the top plate confronting the induction heater. The portion of the top plate confronting the induction heater means a heated portion by the induction heater.

With the light-shading film, the coating density on the infrared heater corresponding portion" is preferably 30–80%, more preferably, 40–80% of the coating density on the induction heater corresponding portion. When the coating density of the infrared heater corresponding portion is 80% or less of the coating density on the induction heater corresponding portion, the infrared light transparency therethrough is sufficient to heat foods on the infrared heater corresponding portion of the top plate. When the coating density of the infrared heater corresponding portion is 30% or more of the coating density on the induction heater corresponding portion, it is sufficient in visible light shading to hide the heater units under the top plate.

In order to lower the coating density an the infrared heater corresponding portion to thereby insure a sufficient infrared transparency, the light-shading film a lot of apertures within a region at the infrared heater corresponding portion. The apertures are preferably distributed uniformly over the infrared heater corresponding portion. Each of the apertures has a diameter of, preferably 0.05–5 mm, more preferably, 0.1–3 mm. The number of apertures is preferably 5–500 per 1 $cm^2$, more preferably 10–500 per 1 $cm^2$.

In another means for increasing the infrared light transparency of the light-shading film at the infrared heater corresponding portion, the coating thickness of the light-shading film is decreased at the infrared heater corresponding portion in relation to the other region. It is preferably about 10–50%, more preferably, 10–40% of the thickness at the region. If it is 10% at the minimum, it is not so distinguished from the other region. If it is 50% at the maximum, it is insured that sufficient infrared light transparency is obtained so as to cook on the top plate by the infrared heater.

Alternatively, a luster layer (metallic glossy film) can be deposited in place of the porous inorganic pigment layer on the infrared heater corresponding portion of the top plate.

Comparing to the porous inorganic pigment layer, the luster layer is higher in the infrared light transparency but has the visible light shading property, although which is lower. Therefore, the luster layer is suitable for the infrared heater corresponding potion of the light-shading film.

From the viewpoint of cost, the luster layer should be deposited within a limited area as small as possible because the luster layer uses expensive materials.

The luster layer is made of an element or a mixture of elements selected from a group of Au, Pt, Pd, Rh, Ru, Bi, Sn, Ni, Fe, Cr, Ti, Ca, Si, and Mg. Preferably, Au, Pd, Bi, Sn, Fe, and Ti are used.

The luster layer has a thickness of, preferably 0.1–10 $\mu$m, more preferably 0.1–5 $\mu$m. The thickness of 0.1 $\mu$m or more can provide the visible-light shading sufficient to shade the heater units mounted under the top plate. If the luster layer has a thickness of 10 $\mu$m or less, the layer can be produced under a limited production cost. It is also possible to use top plate as glass materials.

According to this invention, the light-shading film can be formed on the entire bottom surface of the light-transparent crystallized glass plate but can be partially omitted at, for example, circumference of the heated portion by heater units where LED indicators are formed.

The electromagnetic induction heater unit is usually provided with a thermo-sensor for performing the temperature control, which sensor is disposed under the top plate of the cooking device. The thermo-sensor is, in a mounting manner, fixed onto the bottom surface of the top plate by use of bonding agent.

If the thermo-sensor is fixed to the bottom surface of the top plate of this invention by use of the bonding agent, the bonding agent invades into the pores of the light-shading film of the porous inorganic pigment layer and can be seen from the outside of the top plate. In order to avoid such an ornamental disadvantage, it is desired that a heat resistant resin film is previously formed on the light-shading film.

The heat resistant resin film is required a thermal resistance against a temperature of 200° C. or more. The heat-resistant resin layer may comprise one or more selected from a group of polyimide resin, polyamide resin, fluorine-contained polymer, and silicone resin.

The thickness of the heat-resistant resin layer is preferably 0.01–50 $\mu$m. The layer can prevent the bonding agent from invading into the light-shading film if it has a thickness of 0.01 $\mu$m or more. The maximum thickness of 50 $\mu$m is determined from a view points of material cost and use of the top plate as glass materials.

The heat resistant resin layer can contain heat-resistant organic and/or inorganic pigments so as to adjust the appearance of the light-shading layer.

The heat resistant layer can be formed at the induction heater corresponding portion and also at the other region. For example, it can be formed at a portion of the top plate which is mounted to the cooking device by use of the boding agent. In order to provide a uniform color appearance to the light-shading film, it is desired to deposit the heat-resistant resin layer over the entire surface of the light-shading layer.

The transparent crystallized glass plate used in the top plate according to this invention is preferable colorless and clear but can be colored and clear if the object of this invention can be also attained. The crystallized glass plate is required to have a low thermal expansion coefficient, such as $-10\times10^{-7}$/° C. to $+30\times10^{-7}$/° C., preferably $-10\times10^{-7}$/° C. to $+20\times10^{-7}$/° C., because it is subjected to heat and cool cycles. In the range of the thermal expansion coefficient described above, there is no danger that the top plate breaks due to a thermal expansion difference between various portions of the top plate which are different in temperature. An example of such a crystallized glass plate is N-0 produced by Nippon Electric Glass Co. Ltd.

The top plate according to this invention can be produced according to the following steps.

At first, a transparent Crystallized glass plate is prepared which has a predetermined shape and a size. While, an inorganic pigment paste for the light shading film is prepared by mixing an inorganic pigment powder and a glass powder at a predetermined weight ratio.

The paste is coated by, for example, the screen printing method on a surface (bottom) of the crystallized glass plate to be a heater side, dried and fired, to thereby form a light-shading film. When the luster layer is formed as a portion of the light-shading film, a paste for the luster layer is also printed, dried and fired. Both of the inorganic pigment layer and the luster layer are used, both are formed in the order as you like. Firing can be simultaneously performed for reduction of production cost.

Now, an inorganic pigment paste for ornamental film is prepared by mixing an inorganic pigment powder and a glass powder at a predetermined mixing ratio. Then, the paste is coated by the screen printing method on an opposite surface (top surface) of the crystallized plate, dried and fired to form the ornamental film.

It is possible to form the ornamental film and then form the light-shading film.

Now, Examples will be described below.

EXAMPLE 1

At first, a inorganic pigment paste was prepared by adding resin and organic solvent to a frit comprising Cu—Cr—Mn black inorganic pigment powder, which is available in the commerce, and $B_2O_3$—$SiO_2$ glass powder. The mixing ratio of the inorganic pigment and the glass was 7:3.

Then, the paste was coated by the screen printing on a bottom surface of a light-transparent crystallized glass (N-0 produced by Nippon Electric Glass Co. Ltd.), which has a thickness of 4 mm and an average thermal linear expansion coefficient of $-4\times10^{-7}$/° C. for a temperature range of 30–750° C.

Thereafter, the paste was dried at a temperature of 100–150° C. for 10–20 minutes and then fired at a temperature of 850° C. for 30 minutes.

Thus, a light-shading film 2 was formed on a bottom surface of the crystallized glass 1 as shown in FIG. 1.

The light-shading film was measured to have a thickness of 5 $\mu$m by a film thickness meter. The light shading film has a structure where adjacent inorganic pigment particles are strongly bonded by glass to each other to form a single body, while independent or continuous pores are left between adjacent particles.

On the other hand, another inorganic pigment paste for an ornamental film was prepared by adding resin and organic solvent to a frit comprising $TiO_2$ white inorganic pigment powder and $B_2O_3$—$SiO_2$ glass powder. The mixing ratio of the inorganic pigment and the glass was 3:7.

Then, the paste was coated by the screen printing on a top surface of the light-transparent crystallized glass 1, which was opposite to the bottom surface having the light-shading film 2.

Thereafter, the paste was dried at a temperature of 100–150° C. for 10–20 minutes and then fired at a temperature of 850° C. for 30 minutes.

Thus, the ornamental film 3 was formed on the top surface of the crystallized glass 1 as shown in FIG. 1.

The light-shading film was measured to have a thickness of 5 $\mu$m by a film thickness meter.

The ornamental film has a non-porous structure where the inorganic pigment particles are dispersed in the glass matrix.

It was observed that the top plate as produced has the light-shading film 2 on the bottom surface, which has no crack, and the ornamental film 3 on the top surface, which has a smooth, flat and glossy surface.

EXAMPLE 2

Figure 2:
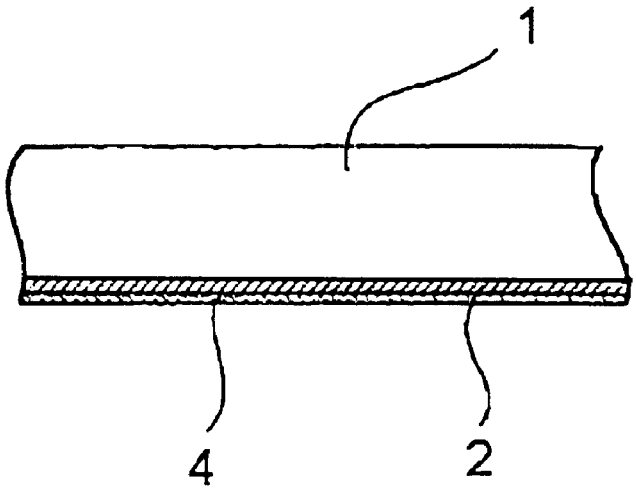
FIG. 2 is a sectional view of a part of a sample used for evaluation of effect of a heat resistant resin used.

A test for evaluating use of the heat-resistant resin layer was performed with a test sample shown in FIG. 2.

The test sample was prepared as follows. The light-shading film 2 of the inorganic pigment layer was formed on a bottom surface of the crystallized glass plate 1, in the similar manner in Example 1. Then, a heat resistant resin of silicone resin was applied or coated on the entire surface of the light-shading film 2, and dried to form the heat-resistant resin layer 4. Thus, the test sample was completed. The heat-resistant resin layer 4 was measured to have 1–3 $\mu$m by the film thickness meter.

On the heat-resistant layer 4, a bonding agent (silicone adhesive) to be used to bond a thermo-sensor was coated. For comparison, another comparing sample was prepared which had the light-shading film 2 alone without the heat-resistant resin layer 4, the bonding agent being directly coated on the light-shading film 2.

Observing both samples from the top surface, the bonding agent was seen in the comparing sample through the crystallized glass plate, but was not seen in the test sample. Thus, use of the heat-resistant layer on the porous light-shading film 2 can shade the use of adhesive on the bottom surface of the top plate and thereby protect the ornamental appearance of the top surface.

EXAMPLE 3

A test was performed to confirm the relationship of the coating density of the light-shading film at the infrared heater corresponding portion with the shading property and cooking property.

Figure 3:
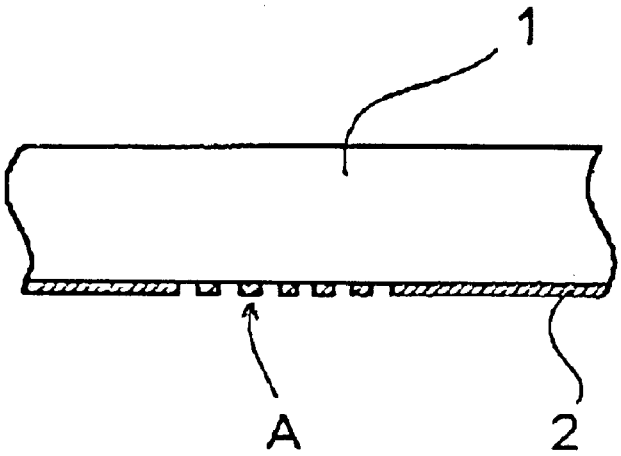
FIG. 3 is a sectional view of a part of a sample used for evaluation of effect of coating density of the shading film.

A plurality of test samples were prepared, each of which comprises the crystallized glass plate 1 and the light-shading film 2 as shown in FIG. 3, in the similar manner as in Example 1, excepting that the plurality of test samples have different coating densities from each other, that is, 0%, 10%, 20%, 30%, 40%, 50%, 60%, 70%, 80%, 90%, and 100%, respectively, at the infrared heater corresponding portions (shown at A in FIG. 3).

The coating densities were adjusted by forming different number of apertures uniformly dispersed in the light-shading films 2 at the infrared heater corresponding portions to adjust the aperture densities formed. Each of the apertures had a diameter of 1 mm. The formation of apertures was performed at the same time upon screen printing the inorganic pigment paste.

The light-shading film was measure to have 5 $\mu$m by the film thickness meter.

Each of the test samples was mounted on the cooking device having an infrared heater unit of 1.5 kW, with the light-shading film 2 confronting the infrared heater unit, and then tested for evaluation of the light shading and cooling properties. The test results are shown in Tables 1 and 2.

TABLE 1

| Coating density | 0% | 10% | 20% | 30% | 40% | 50% |
|---|---|---|---|---|---|---|
| Light-shading | X | Δ | Δ | Δ | ○ | ○ |
| Boiling time (min.) | 1 | 1 | 1 | 2 | 2 | 2 |

TABLE 2

| Coating density | 60% | 70% | 80% | 90% | 100% |
|---|---|---|---|---|---|
| Light-shading | ○ | ○ | ○ | ○ | ○ |
| Boiling time (min.) | 3 | 3 | 5 | 12 | 20 |

With respect to light-shading property, evaluation was made by viewing the top plate thereabove, and determined that a sample where the infrared heater unit could be clearly viewed was "not good" and given with a mark X, another sample where it could not be viewed at all was "good" and given with a mark ○, another sample where it could be viewed but not clearly was given with a mark Δ.

With respect to the cooking property, evaluation was made by the boiling time (minutes) in a case where a 100 ml water contained in a 300 ml pot was put on each of the test samples and heated until boiled by the infrared heater operated with full power.

It is noted from Tables 1 and 2 that the internal structure is hardly seen when the coating density of the light-shading film is 10% or more, and cannot be seen at all when it is 40% or more. These coating densities can give a desired appearance of the cooking device.

On the other hand, the water can be boiled for a short time that is convenient in the actual use when the coating density is 90% or less, and rapidly boiled when it is 80% or less.

EXAMPLE 4

Figure 4A:
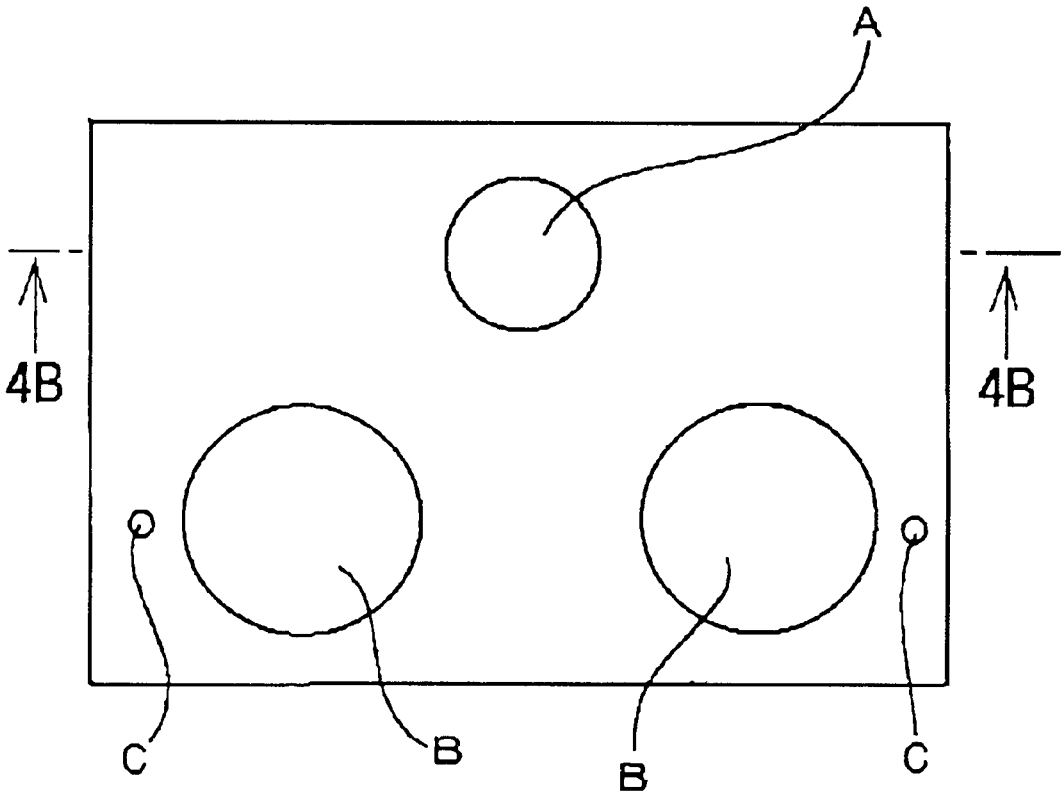
FIG. 4A is a bottom view of a part of a top plate according to a different embodiment of this invention.
Figure 4B:
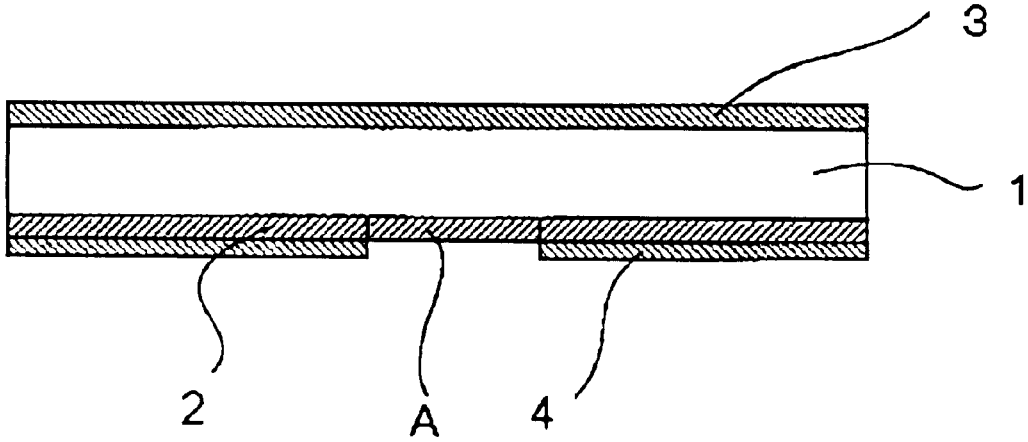
FIG. 4B is a sectional view taken along a line 4B—4B in FIG. 4A.

Referring to FIGS. 4A and 4B, a top plate having an infrared heater corresponding portion A and two induction heater corresponding portions B were produced as follows. When the cooking apparatus has a light indicator such as LEDs disposed adjacent the induction heater for indicating an operating power of the induction heater, the bottom surface of the crystallized glass plate 1 is free from the light-shading film 2 at a position or positions (shown as holes C in FIG. 4A) corresponding to the light indicator and is partially exposed.

At first, the light-shading film 2 was formed on the bottom surface of the crystallized plate 1, with the coating density being 50% at the infrared heater corresponding portion (apertures not shown in FIG. 4B) and 100% at the remaining portion including two regions B, in the similar manner as in Example 3.

The ornamental film 3 was formed on the top surface of the crystallized glass plate 1 in the similar manner as in Example 1. Holes C are formed simultaneously upon screen printing of the paste to partially expose the bottom surface of the plate 1 for transmitting the light form the light indicator.

Then, the heat-resistant resin of silicone resin was coated, by the screen printing, on the light-shading film 2 over the entire surface other than the infrared heater unit corresponding portion A, and dried to form the heat-resistant resin layer 4.

The heat-resistant resin layer 4 was measured to have a thickness of 1–3 $\mu$m by the film thickness meter.

On the heat-resistant resin layer 4, silicone adhesive was coated.

The top plate produced was mounted on a cooking device having an infrared heater unit of 1.5 kW and two induction heater units of 1.5 kW, with the infrared heater corresponding portion A and the induction heater corresponding portions B confronting the infrared heater and the two induction heaters, respectively.

The viewing the adhesive, light-shading property and the cooking property were tested in the similar manner as in Examples 2 and 3.

As a result, the adhesive and the internal structure were not seen through the top plate at all. Cooking property was determined good because the water was boiled within 5 minutes by use of any one of the infrared heater unit and induction heater unit operated with the full power.

EXAMPLE 5

A test was performed to confirm the relationship of the coating thickness of the light-shading film at the infrared heater corresponding portion with the shading property and cooking property.

Figure 5:
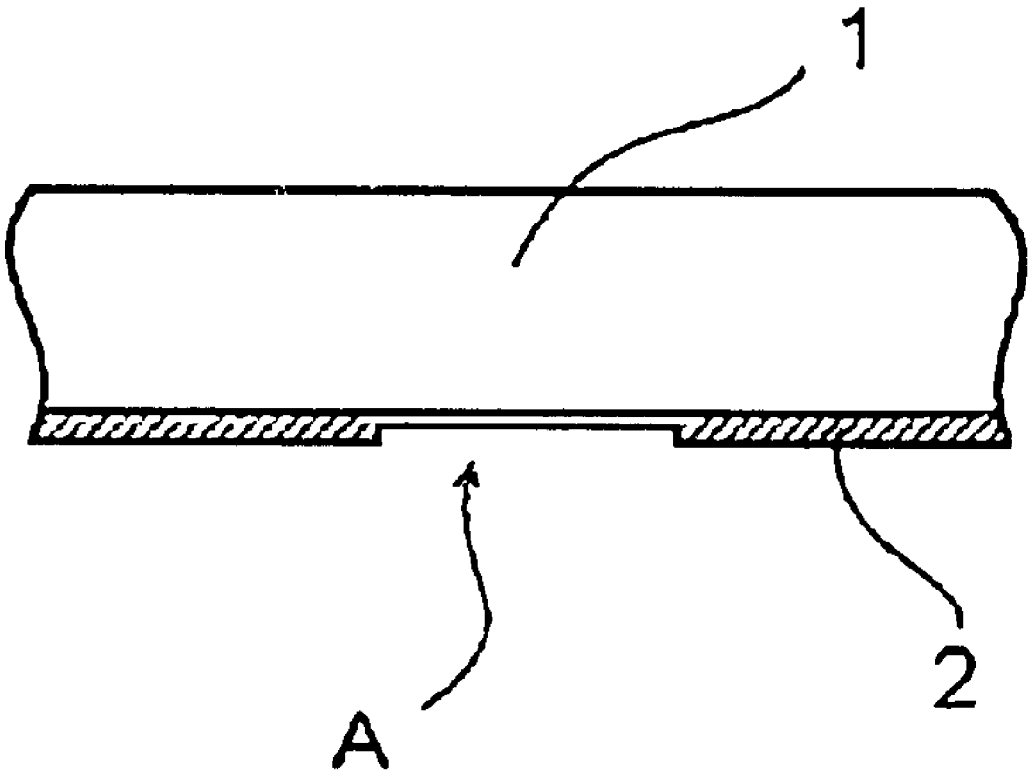
FIG. 5 is a sectional view of a part of a sample used for evaluation of effect of film thickness of the shading film.

A plurality of test samples were prepared, each of which comprises the crystallized glass plate 1 and the light-shading film 2 as shown in FIG. 5, in the similar manner as in Example 1, excepting that the plurality of test samples have different coating thickness values at the infrared heater corresponding portions (shown at A in FIG. 5). That is, the different thickness values were 0%, 10%, 20%, 30%, 40%, 50%, 60%, 70%, 80%, 90%, and 100% of the thickness at the other portion than the infrared heater corresponding portion.

The different coating thickness was adjusted by adjusting the printing time number and the kind of screen used.

The light-shading film at the remaining portion other than the infrared heater corresponding portion A was measure to have 5 $\mu$m by the film thickness meter.

Each of the test samples was mounted on the cooking device having an infrared heater unit of 1.5 kW, with the light-shading film 2 confronting the infrared heater unit, and then tested for evaluation of the light shading and cooking properties. The test results are shown in Tables 3 and 4.

TABLE 3

| Coating thickness | 0% | 10% | 20% | 30% | 40% | 50% |
|---|---|---|---|---|---|---|
| Light-shading | X | ○ | ○ | ○ | ○ | ○ |
| Boiling time (min.) | 1 | 3 | 3 | 4 | 4 | 5 |

TABLE 4

| Coating thickness | 60% | 70% | 80% | 90% | 100% |
|---|---|---|---|---|---|
| Light-shading | ○ | ○ | ○ | ○ | ○ |
| Boiling time (min.) | 7 | 9 | 11 | 15 | 30 |

With respect to light-shading property, evaluation was made by viewing the top plate thereabove, and determined that a sample where the infrared heater unit could be clearly viewed was "not good" and given with a mark X, and another sample where it could not be viewed at all was "good" and given with a mark ○.

With respect to the cooking property, evaluation was made by the boiling time (minutes) in a case where a 100 ml water contained in a 300 ml pot was put on each of the test samples and heated until boiled by the infrared heater operated with full power.

It is noted from Tables 3 and 4 that the internal structure cannot be seen at all when the coating thickness is 10% or more. This coating thickness can give a desired appearance of the cooking device.

On the other hand, the water can be boiled for a short time that is convenient in the actual use when the coating thickness is 80% or less, and rapidly boiled when it is 50% or less.

EXAMPLE 6

Figure 6A:
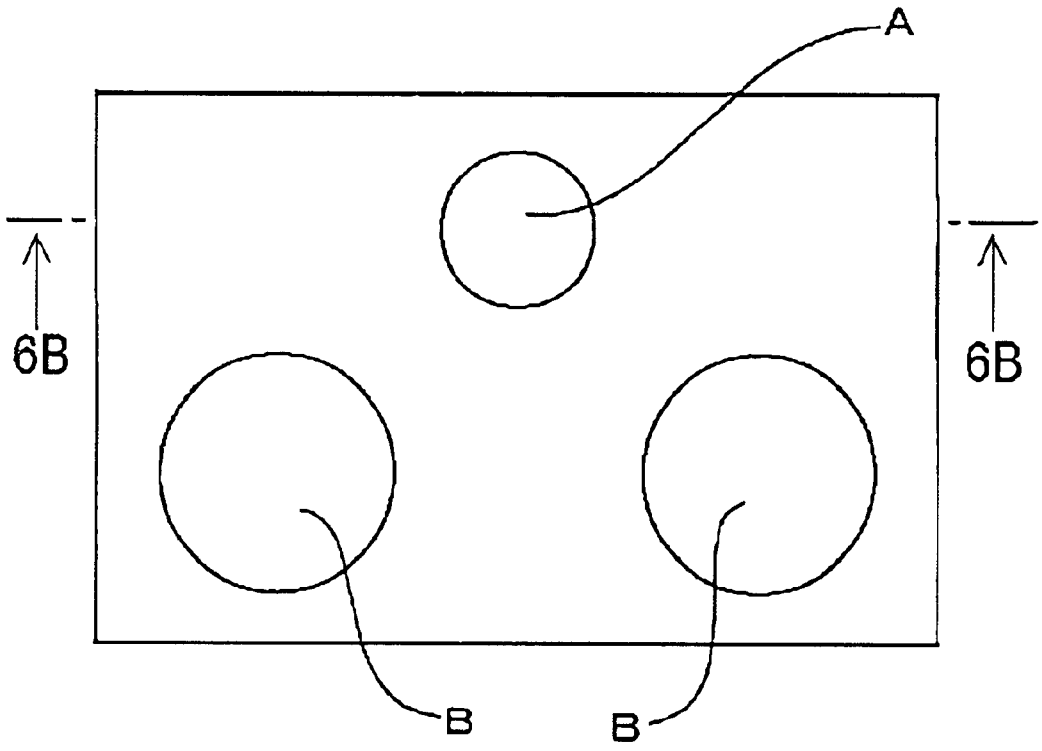
FIG. 6A is a bottom view of a top plate according to another different embodiment.
Figure 6B:
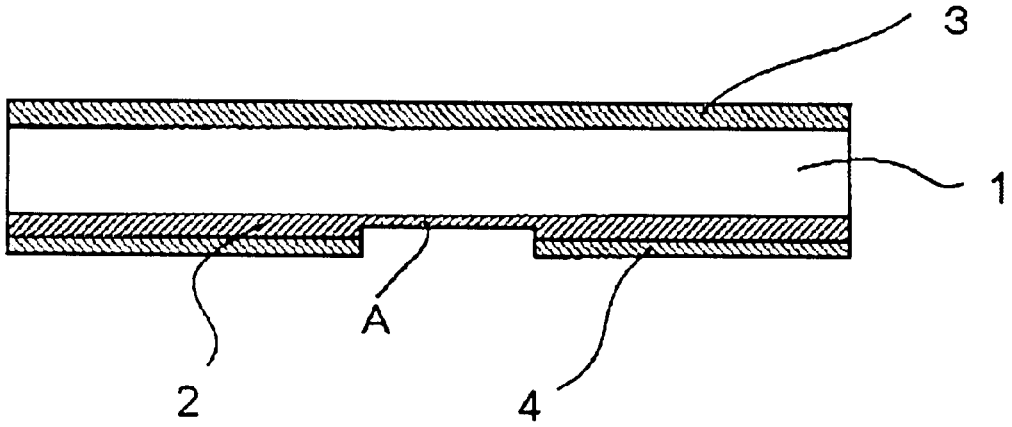
FIG. 6B is a sectional view taken along a line 6B—6B in FIG. 6A.

Referring to FIGS. 6A and 6B, a top plate having an infrared heater corresponding portion A and two induction heater corresponding portions B were produced as follows.

At first, the light-shading film 2 was formed on the bottom surface of the crystallized plate 1, with the coating thickness at the infrared heater corresponding portion being 20% of that at the remaining portion including two regions B, in the similar manner as in Example 5.

The ornamental film 3 was formed on the top surface of the crystallized glass plate 1 in the similar manner as in Example 1.

Then, the heat-resistant resin of silicone resin was coated, by the screen printing, on the light-shading film 2 over the entire surface other than the infrared heater unit corresponding portion A, and dried to form the heat-resistant resin layer 4.

The heat-resistant resin layer 4 was measured to have a thickness of 1–3 $\mu$m by the film thickness meter.

On the heat-resistant resin layer 4, silicone adhesive was coated.

The top plate produced was mounted on a cooking device having an infrared heater unit of 1.5 kW and two induction heater units of 1.5 kW, with the infrared heater corresponding portion A and the induction heater corresponding portions B confronting the infrared heater and the two induction heaters, respectively, in the similar manner as in Example 4.

The viewing the adhesive, light-shading property and the cooking property were tested in the similar manner as in Examples 2 and 3.

As a result, the adhesive and the internal structure were not seen through the top plate at all. Cooking property was determined good because the water was boiled within 5 minutes by any one of the infrared heater unit and induction heater unit operated with the full power.

EXAMPLE 7

Figure 7A:
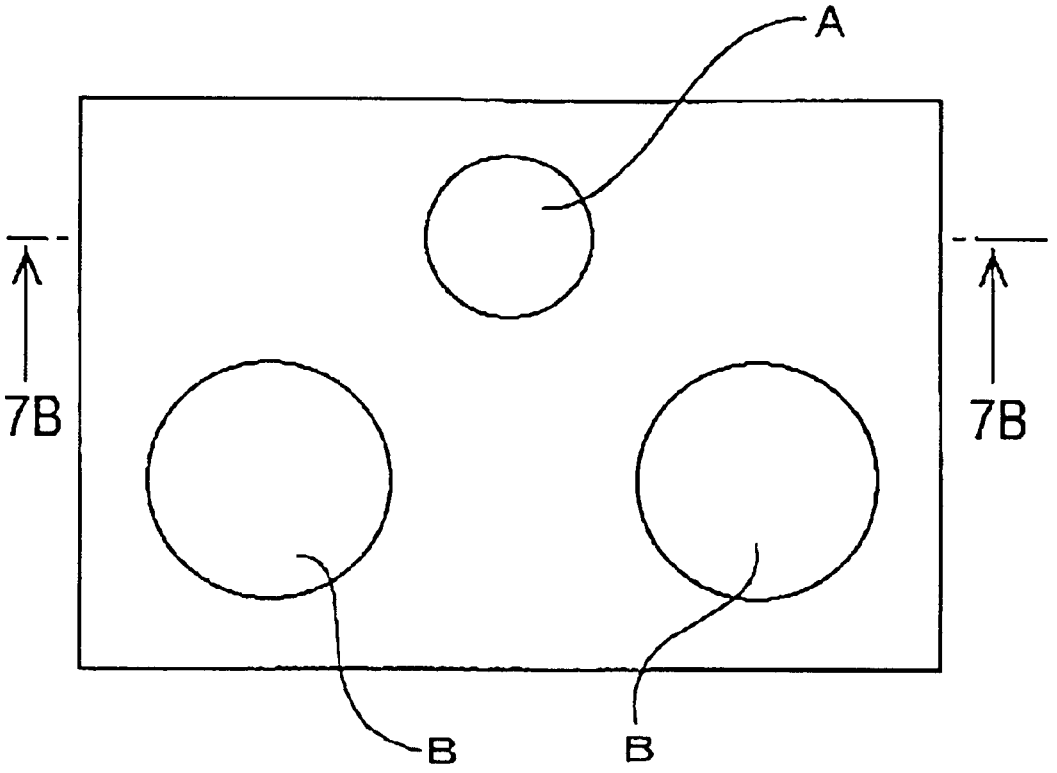
FIG. 7A is a bottom view of a top plate according to a further different embodiment.
Figure 7B:
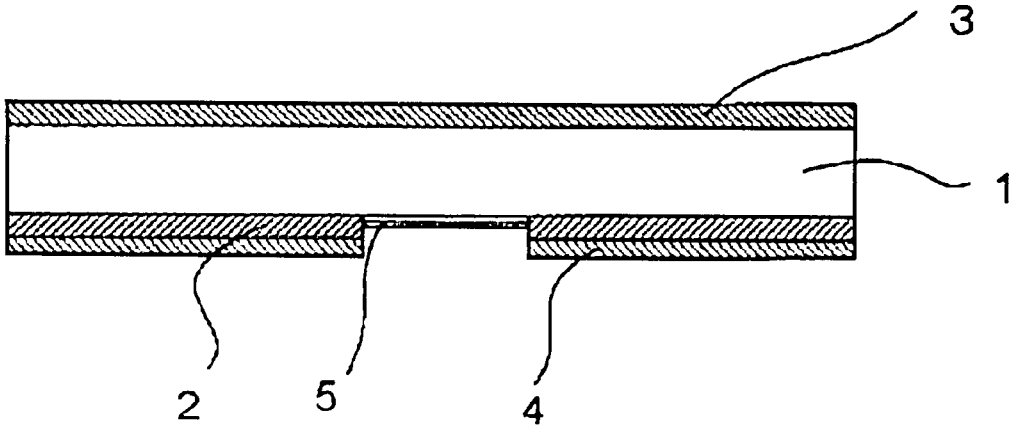
FIG. 7B is a sectional view taken along a line 7B—7B in FIG. 7A.

Referring to FIGS. 7A and 7B, a top plate was prepared which comprises the crystallized glass plate 1 (N-0 like that in Example 1), a light shading film comprising an inorganic pigment layer 2 and a luster layer 5 formed on the bottom surface of the plate 1, an ornamental film 3 on the top surface of the plate 1, and a heat-resistant resin layer 4 on the inorganic pigment layer 2.

At first, an Au-containing luster paste, which is available in the commerce, was coated by the screen printing over a limited area on the bottom surface of the crystallized glass plate, then dried at a temperature of 100–150° C. for 30 minutes and fired at a temperature of 850° C. for 30 minutes to form the luster film 5 at the infrared heater corresponding portion A. The luster film 5 was measured to have a thickness of 2 $\mu$m by the film thickness meter.

Then, an inorganic pigment paste for the light-shading film was prepared in the similar manner as in Example 1 and was coated by the screen printing at the entire region other than the luster film 5 on the bottom surface of the crystallized glass plate 1, then dried at a temperature of 100–150° C. for 10–20 minutes, and thereafter fired at a temperature of 850° C. for 30 minutes to thereby form the light-shading inorganic pigment layer 2 at the other region including the induction heater corresponding portions B. A thickness of the layer 2 was 5 $\mu$m by measurement using the film thickness meter.

Further, a heat-resistant resin layer 4 was coated on the entire surface of the inorganic pigment layer 2 by screen printing the paste and drying it. The thickness of the resin layer 4 was measured 1–3 $\mu$m.

Thus, the top plate was prepared and was mounted on a cooking device having an infrared heater unit of 1.5 kw and two induction heater units of 1.5 kW, with the infrared heater corresponding portion A and the induction heater corresponding portions B confronting the infrared heater and the two induction heaters, respectively, in the similar manner as in Example 4.

The viewing the adhesive, light-shading property and the cooking property were tested in the similar manner as in Examples 2 and 3.

As a result, the adhesive and the internal structure were not seen through the top plate at all. Cooking property was determined good because the water was boiled within 5 minutes by use of any one of the infrared heater unit and induction heater unit operated with the full power.

This invention has been described in detail with respect to several embodiments and examples but is not limited to those embodiments and examples. It will be understood from the description by those skilled in the art that various other embodiments and modifications can be made within the scope and spirits of this invention determined in claims attached hereto.

What is claimed is:

1. A top plate in a cooking device having an electromagnetic-induction heating unit, which comprises:

a light-transparent crystallized glass plate with a top surface, on which foods are heated, and with a bottom surface confronting the electromagnetic-induction heating unit;

an ornamental film entirely or partially coated on said top surface, said ornamental film being a dense layer comprising a first inorganic pigment, and;

a light-shading film entirely or partially coated on said bottom surface, said light-shading film being a porous layer comprising a second inorganic pigment.

2. The top plate claimed in claim 1, wherein said dense layer comprises a first inorganic pigment powder and glass, while said porous layer comprises a second inorganic pigment powder and glass.

3. The top plate claimed in claim 2, wherein said dense layer is higher than said porous layer in the glass percentage content.

4. The top plate claimed in claim 1, having a heated portion heated by the electromagnetic-induction heating unit, wherein said top plate further comprises a heat resistant resin layer formed on at least one area of said light-shading film corresponding to said heated portion.

5. The top plate claimed in claim 4, wherein said heat-resistant resin layer comprises one or more selected from a group of polymide resin, polyamide resin, fluorine-contained polymer, and silicone resin.

6. The top plate claimed in claim 1, adapted to be used in a cooking device having an infrared heating unit in addition to the electromagnetic-induction heating unit, said top plate having a first heated portion heated by the electromagnetic-induction heating unit and a second heated portion heated by said infrared heating unit.

7. The top plate claimed in claim 6, wherein said light-shading film is lower in the density at the second heated portion than that at the first heated portion.

8. The top plate claimed in claim 7, wherein the density of said light-shading film at said second heated portion is 30–80% of that at said first heated portion.

9. The top plate claimed in claim 6, wherein said light-shading film is a lot of apertures at said second heated portion.

10. The top plate claimed in claim 9, wherein said light-shading film has apertures of 0.05–5 mm diameter at said second heated portion.

11. The top plate claimed in claim 9, wherein said light-shading film has 5–500 apertures per 1 $cm^2$ at said second heated portion.

12. The top plate claimed in claim 6, wherein said light-shading film is smaller in the thickness at the second heated portion than that at the first heated portion.

13. The top plate claimed in claim 12, wherein the thickness of said light-shading film at said second heated portion is 10–50% of that at said first heated portion.

14. The top plate claimed in claim 6, wherein said light-shading film is formed in a luster layer at said second heated portion.

15. The top plate claimed in claim 1, the cooking apparatus having a light indicator disposed adjacent the electromagnetic induction heating unit for indicating an operating power of the electromagnetic induction heating unit, wherein the bottom surface of the crystallized glass plate is free from said light-shading film at a position corresponding to the light indicator and is partially exposed.

* * * * *